US006350166B1

(12) United States Patent
Herrera

(10) Patent No.: US 6,350,166 B1
(45) Date of Patent: Feb. 26, 2002

(54) OUTBOARD ENGINE WITH RESONANCE-AVOIDING EXHAUST HOUSING

(75) Inventor: Eric Herrera, Burlington, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/571,752

(22) Filed: May 15, 2000

(51) Int. Cl.[7] ..... B63H 21/26

(52) U.S. Cl. ..... 440/89; 440/76; 440/78; 440/88; 440/60; 440/312; 440/313; 440/314

(58) Field of Search ..... 440/89, 88, 76, 440/78; 60/312, 313, 314

(56) References Cited

U.S. PATENT DOCUMENTS 3,967,446 A * 7/1976 Harralson et al. ..... 60/312
4,337,054 A * 6/1982 Holtermann et al. ..... 440/89
4,795,383 A * 1/1989 Binversie et al. ..... 440/89
4,940,435 A * 7/1990 Osborn et al. ..... 440/89
5,149,284 A * 9/1992 Kawai ..... 440/52
5,171,177 A * 12/1992 Hubbell ..... 440/78
5,494,467 A * 2/1996 Sohgawa et al. ..... 440/89
6,056,611 A 5/2000 House et al. ..... 440/88

* cited by examiner

*Primary Examiner*—S. Joseph Morano
*Assistant Examiner*—Lars A. Olson
(74) *Attorney, Agent, or Firm*—Dennis M. Flaherty

(57) ABSTRACT

A propulsion system for a boat has a powerhead or a motor with an exhaust port for exhaust gases. The exhaust gases are exhausted through the propeller hub via an exhaust housing. The exhaust housing is a walled enclosure having an inlet, an internal volume in flow communication with the inlet, and an outlet in flow communication with the internal volume. The exhaust housing further includes hollow structures for dividing a portion of the internal volume into a plurality of flow channels which extend in side-by-side relationship. The transverse dimensions of each flow channel is substantially less than the transverse dimensions of the walled enclosure. The result is that standing waves are shifted to a higher frequency range. The hollow dividing structures have internal volumes which communicate with space external to the exhaust housing via openings in the walled enclosure, which allow the admission of a cooling medium. The hollow structures increase the stiffness of the walled enclosure of the exhaust housing.

35 Claims, 9 Drawing Sheets

OUTBOARD ENGINE WITH RESONANCE-AVOIDING EXHAUST HOUSING

FIELD OF THE INVENTION

This invention generally relates to means for suppressing noise in an outboard marine engine. In particular, the present invention relates to means for suppressing noise transmitted from the exhaust housing of an outboard engine.

BACKGROUND OF THE INVENTION

Typical marine engines are noisy, especially when being operated at higher rpm's while driving a vessel rapidly through the water. This noisy operation is extremely unattractive to occupants of the vessel, as well as to passers-by, and it is highly desirable to reduce this noise without reducing vessel efficiency. Further, regulatory bodies, in their desire to improve the environment, are imposing emission standards on marine vessels. These standards not only regulate the contents of the emissions but also apply to the noise level of the emission. It is therefore highly desirable to provide a marine engine that is noise reduction efficient without detracting from the vessel operating efficiently.

More general than the noise reduction is noise control. Noise control requires an understanding of the vibro-acoustic behavior of the article in question with its environment. If boundary conditions permit, approximations can be made by isolating the article from its environment. This cannot be done "simply" for an integrated structure. For example, an outboard marine engine is an integrated structure. To capture correctly the vibro-acoustic behavior of an outboard engine, the engine should be fully assembled, mounted to a boat and in the open water. For example, feedback from the added inertia of the water as the boat travels in the water could produce a narrow-band spectrum different from a steady-state condition. There is also feedback from the components of the engine, for example, the crankshaft and block can produce a phenomenon that does not exist for either part acting alone.

To determine the acoustic "fingerprint" for an integrated structure such as an outboard marine engine, a narrow-band analysis must be performed. This will allow identification of tones, i.e., frequency responses, of the interacting components. The components corresponding to these responses can be identified from the frequencies, i.e., based on wavelength and speed of sound. Vibro-acoustic treatments can be designed and or critically placed to attenuate or simply move a tone from one frequency to another. The effectiveness of this effort is based on the precision of the data and the methodology by which the data is acquired.

The precision of the data is a function of the frequencies of the data collected and of the transducer sensitivity. The frequency range of interest is a function of human hearing, i.e., 10 kHz is sufficient. For the present work, data was collected using accelerometers and microphones. Accelerometer data was collected to 5 kHz at 1 Hz bandwidth; microphone data was collected to 10 kHz at 2.5 Hz bandwidth. Acoustic intensity testing and stethoscopic probing both showed agreement that over 80% of the vibro-acoustic energy produced by a particular outboard marine engine was coming from below the interface between the engine's upper and lower motor covers, a large part of the noise being transmitted from the exhaust housing. It was further discovered that a particular tone produced inside the exhaust housing did not change frequency as the rpm of the engine was modulated. This discovery led to the realization that a standing wave was being set up inside the exhaust housing, causing the exhaust housing to vibrate at low frequency (in one case, at about 3,500 Hz).

Thus there is a need for a structure which can be incorporated inside an exhaust housing of an outboard marine engine to break up standing waves and reduce noise output.

SUMMARY OF THE INVENTION

The present invention is directed to an improved exhaust housing having means for breaking up standing acoustic waves resonating inside the exhaust housing. Such standing waves intensify and prolong the acoustic noise transmitted from the exhaust housing. A standing acoustic wave can be produced when the passage through which air, e.g., exhaust gas, flows has a dimension which equals at least one fourth the speed of sound divided by the frequency of the standing wave.

In accordance with the preferred embodiment of the invention, this resonant condition is eliminated by incorporating plates inside the exhaust housing. These resonance-avoiding plates are generally parallel to the direction of flow from the powerhead and are welded to the walls of the exhaust housing. (The terms "powerhead" and "motor" will be used interchangeably throughout the written description and the claims.) The resonance-avoiding plates divide the exhaust housing into multiple channels, each channel having transverse dimensions smaller than the transverse dimensions of the unmodified exhaust housing. Consequently, any standing acoustic wave in one of the channels will have a frequency higher than the frequency of a standing wave in the unmodified exhaust housing. In addition, the plates serve to increase the stiffness of the exhaust housing, changing the mode of vibration of the exhaust housing from low to high frequency. As a result, the tones produced by the vibrating exhaust housing will be moved to higher frequencies, i.e., further away from the so-called Speech Interference Level 123 (SIL123) corresponding to the frequency range from 1,000 to 3,000 hertz.

The broad concept of the invention is directed to a boat propulsion system having a motor with an exhaust port for exhaust gases, the exhaust gases being exhausted via a resonance-avoiding exhaust housing. The exhaust housing is a walled enclosure having an inlet, an internal volume in flow communication with the inlet, and an outlet in flow communication with the internal volume. The exhaust housing further includes hollow structures for dividing a portion of the internal volume into a plurality of flow channels which extend in side-by-side relationship. The transverse dimensions of each flow channel is substantially less than the transverse dimensions of the walled enclosure. The result is that standing waves are shifted to a higher frequency range. The hollow dividing structures have internal volumes which communicate with space external to the exhaust housing via openings in the walled enclosure, which allow the admission of a cooling medium. The hollow structures also increase the stiffness of the walled enclosure of the exhaust housing, shifting the vibration mode of the exhaust housing to higher frequencies.

The invention further encompasses a method of retrofitting an engine exhaust housing comprising a walled enclosure having an inlet, an internal volume in flow communication with said inlet, and an outlet in flow communication with said internal volume. The retrofitting method comprises the step of dividing a portion of the exhaust housing internal volume into a plurality of flow channels which extend in side-by-side relationship. Each of the flow channels has an inlet which is closer to the exhaust housing inlet than the flow channel outlet is and an outlet which is closer to the exhaust housing outlet than the flow channel inlet is. The dividing step is accomplished by installing a hollow structure having an opening inside the internal volume of the exhaust housing, and forming an opening in the walled enclosure at a location such that the opening of the walled enclosure is in flow communication with the opening of the hollow structure. The installing step comprises the steps of attaching rigid plates to the walled enclosure such that the stiffness of the walled enclosure is increased.

DETAILED DESCRIPTION OF THE PREFERRED EMBODIMENTS

Figure 1:
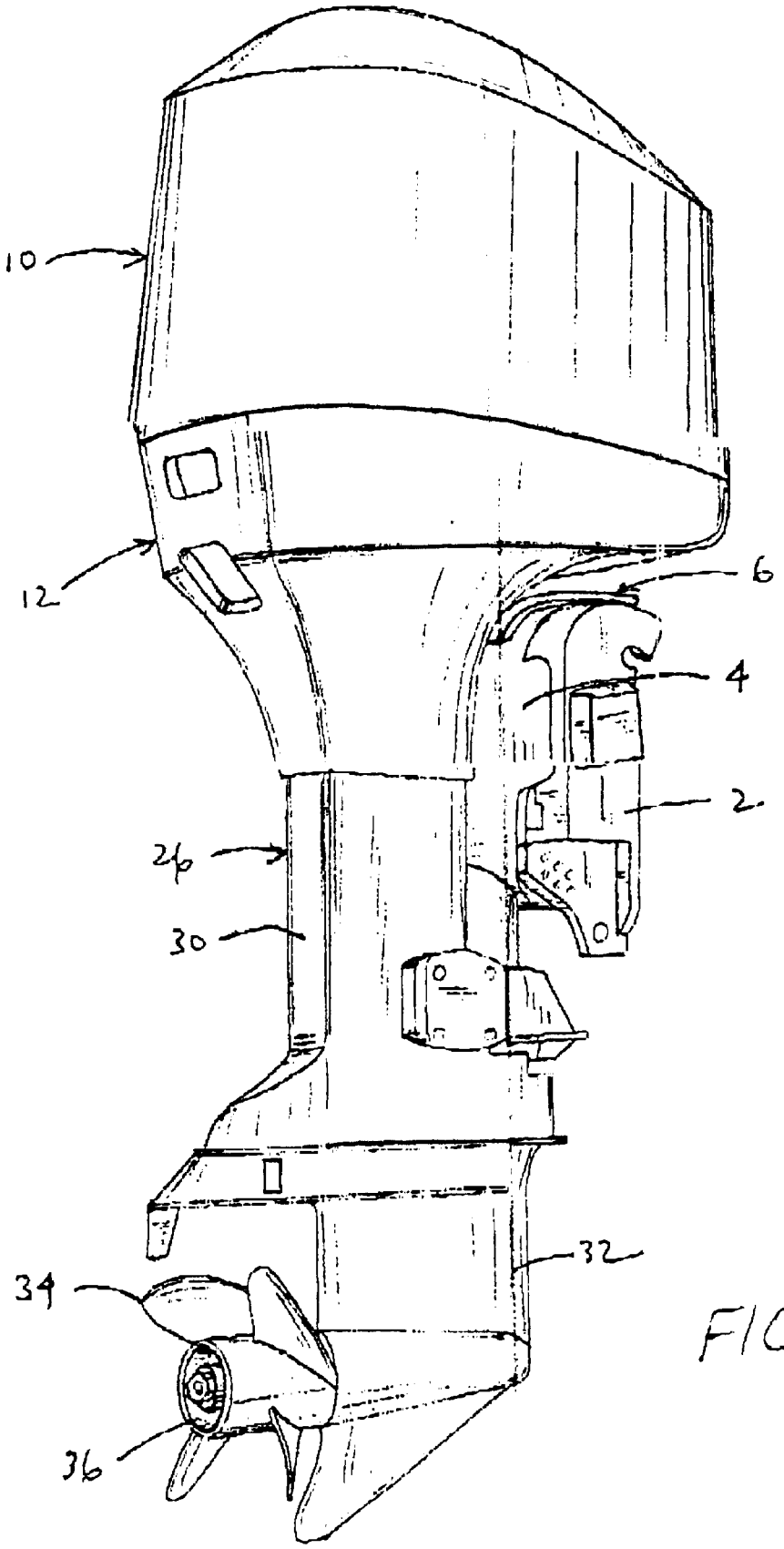
FIG. 1 is a schematic showing a typical outboard marine engine to which the present invention can be applied.

An outboard propulsion unit and means for mounting that propulsion unit to the stern of a boat are shown in FIG. 1. The mounting means comprise a pair of stern brackets 2 (only one of which is visible in FIG. 1) designed to be mounted to the boat stern. A swivel bracket 4, which supports the propulsion unit, is pivotably mounted to the stern brackets 2. The swivel bracket 4 allows the propulsion unit to be tilted about a horizontal axis. The swivel bracket 4 rotatably supports a steering arm assembly 6 (only part of which is visible in FIG. 1) which is rigidly connected to the propulsion unit, to allow the propulsion unit to be turned about the axis of the steering arm assembly 6 for steering the boat.

The propulsion unit comprises a powerhead 8 (visible in FIG. 2) housed in a casing formed by an upper motor cover assembly 10 and a lower motor cover assembly 12. The lower motor cover assembly has an oval-shaped opening that allows the steering arm assembly to penetrate the lower motor cover assembly and attach to the assembly (described below) which supports the powerhead. The upper motor cover is preferably made of acetyl butyl styrene, while the lower motor cover is preferably made of fiberglass.

Figure 3:
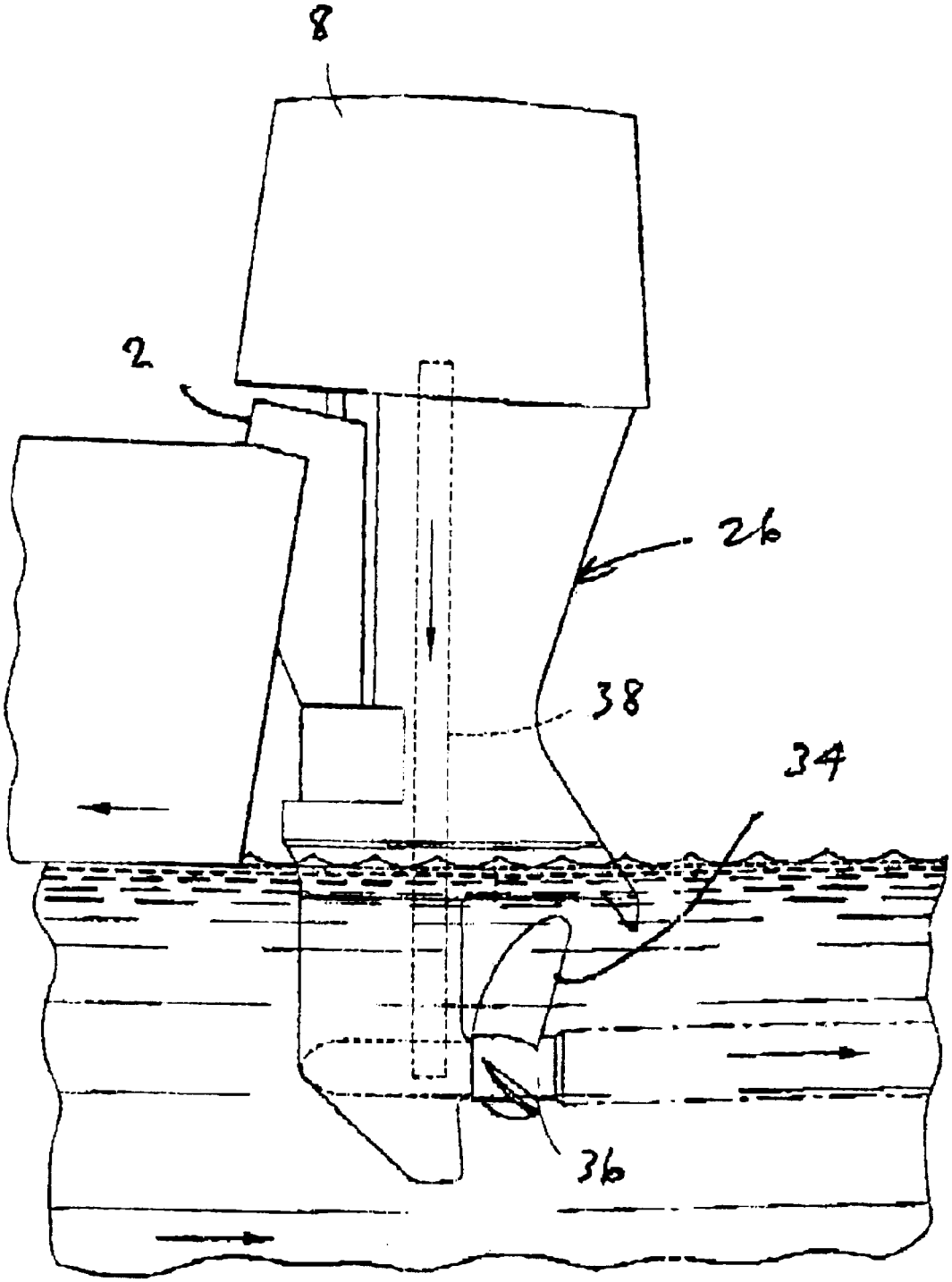
FIG.3 PRIOR ART
FIG. 3 is a schematic showing a prior art technique for exhausting gases from a powerhead of an outboard engine through the propeller.

Referring again to FIG. 1, the weight of the powerhead 8 is supported by an exhaust housing assembly 26, which is in turn mounted to the swivel bracket 4 in a known manner. Exhaust from the powerhead flows downward through a passageway in the exhaust housing assembly. A gear case 32 is attached to the bottom of the exhaust housing assembly 26. The gear case houses the lowermost part of the vertical drive shaft (not shown) which is coupled to the powerhead, the propeller shaft (not shown) and the gears (not shown) for converting rotation of the drive shaft into rotation of the propeller shaft. A propeller 34 is mounted on the end of the propeller shaft in conventional manner. The exhaust gases flow through the inner exhaust housing and are exhausted below the waterline through an outlet in the propeller hub 36. This arrangement is well-known in the prior art and is generally depicted in FIG. 3, which shows a path 38 for the flow of exhaust gas from an exhaust port of the powerhead 8 to the hollow propeller hub 36.

Figure 4:
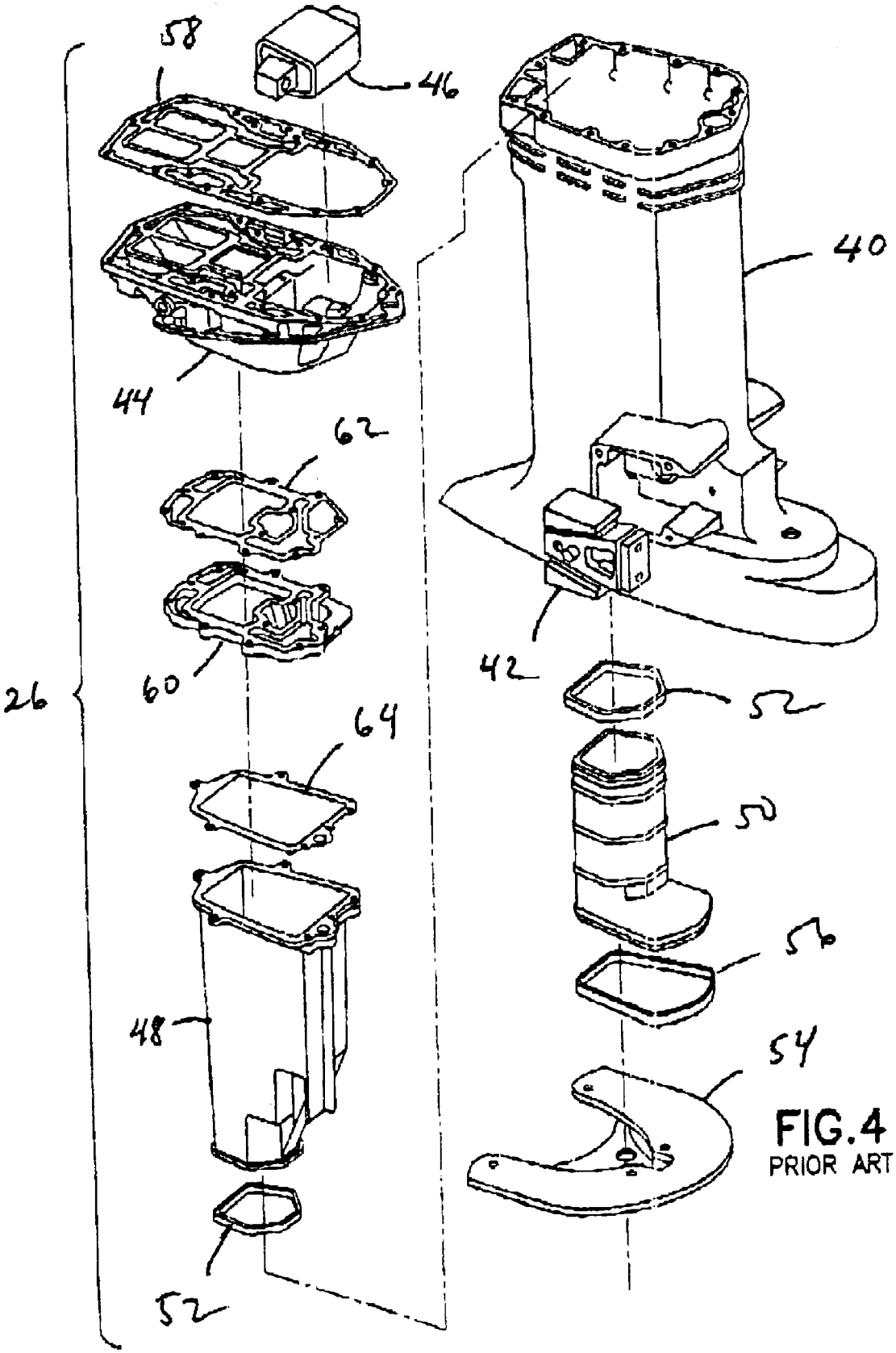
FIG.4 PRIOR ART
FIG. 4 is a schematic showing an exploded view of a known exhaust housing assembly.

The components of a known exhaust housing assembly 26 are shown in the exploded view of FIG. 4. The assembly comprises an outer exhaust housing 40 which is attached to the swivel bracket (item 4 in FIGS. 1 and 2) via a pair of lower rubber mounts 42 (only one of which is shown in FIG. 4). The outer exhaust housing 40 supports the powerhead via an exhaust housing adapter 44, on which the powerhead sits. The steering arm assembly (item 6 in FIG. 1) is coupled to an upper rubber mount assembly 46, which is installed within a recess in the exhaust housing adapter 44.

The exhaust housing assembly 26 further comprises an inner exhaust housing which is supported inside the outer exhaust housing. The inner exhaust housing has an inlet at the top which is in flow communication with the exhaust port of the powerhead, and an outlet at the bottom which is in flow communication with the hollow propeller hub. The inner exhaust housing comprises an upper inner exhaust housing 48 and a lower inner exhaust housing 50. The outlet at the bottom of the upper inner exhaust housing 48 is connected to the inlet at the top of the lower inner exhaust housing 50, the interface being sealed by a pair of exhaust housing seals 52. Other components shown in FIG. 4 are as follows: item 54 is a spray deflector; item 56 is a seal placed between the gear case and the lower inner exhaust housing 50; item 58 is a gasket placed between the adapter 44 and the powerhead; item 60 is a water plate which directs water and exhaust into the exhaust section; item 62 is a gasket placed between the adapter 44 and the water plate 60; and item 64 is a gasket placed between the upper inner exhaust housing 48 and the water plate 60. The adapter 44, the outer exhaust housing 40 and the inner exhaust housing 48, 50 are preferably made of aluminum.

Figure 2:
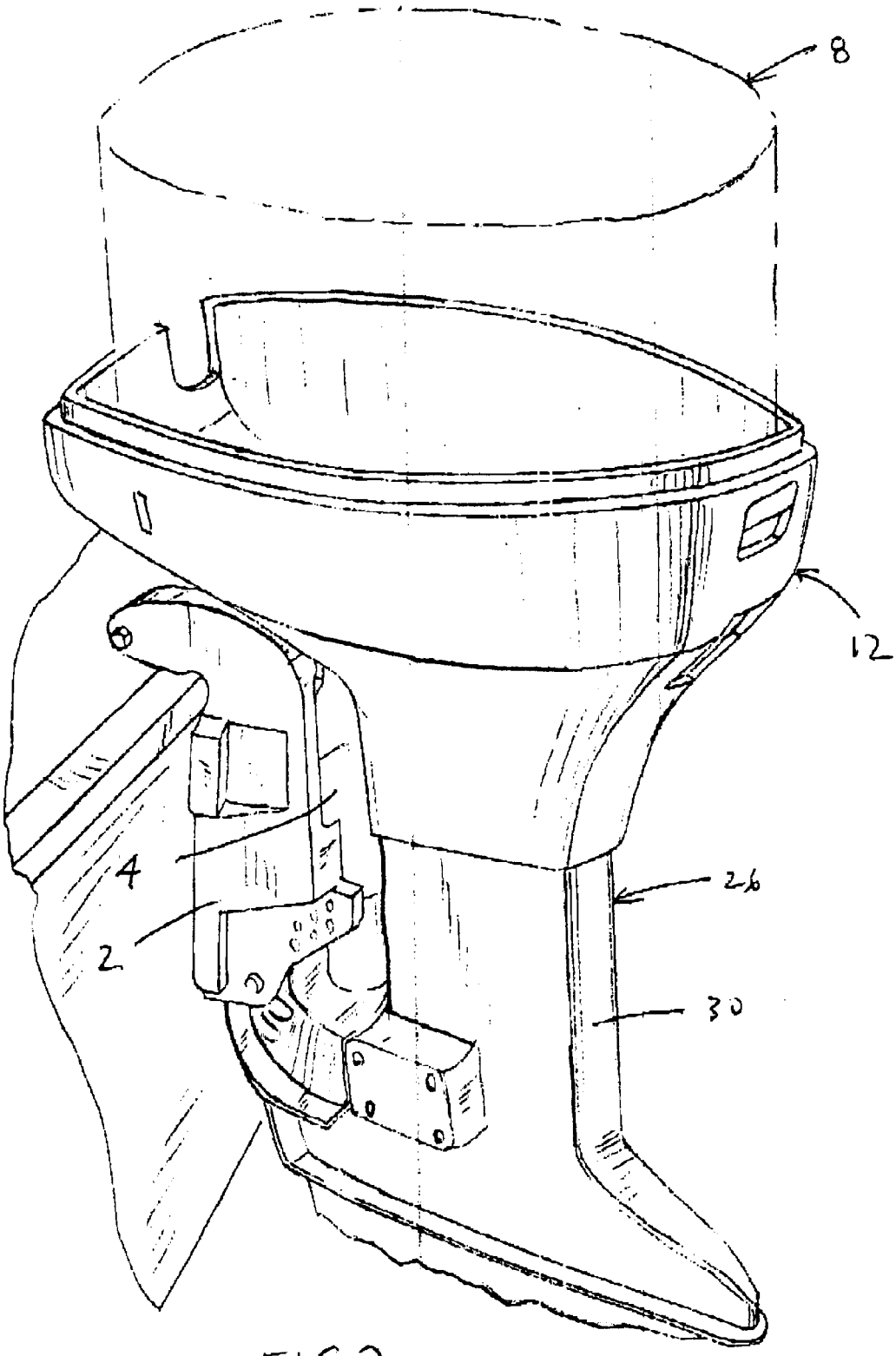
FIG. 2 is a schematic showing the outboard marine engine of FIG. 1 with the upper motor cover removed to reveal the powerhead.

During operation of the prior art engine depicted in FIGS. 1, 2 and 4, an undesirable near-SIL123 frequency noise component is associated with maintenance of a standing acoustic wave inside the upper inner exhaust housing 48. In accordance with the preferred embodiment of the invention, that near-SIL123 standing wave can be eliminated by modifying the upper inner exhaust housing as described below with reference to FIGS. 5–9.

Figure 5:
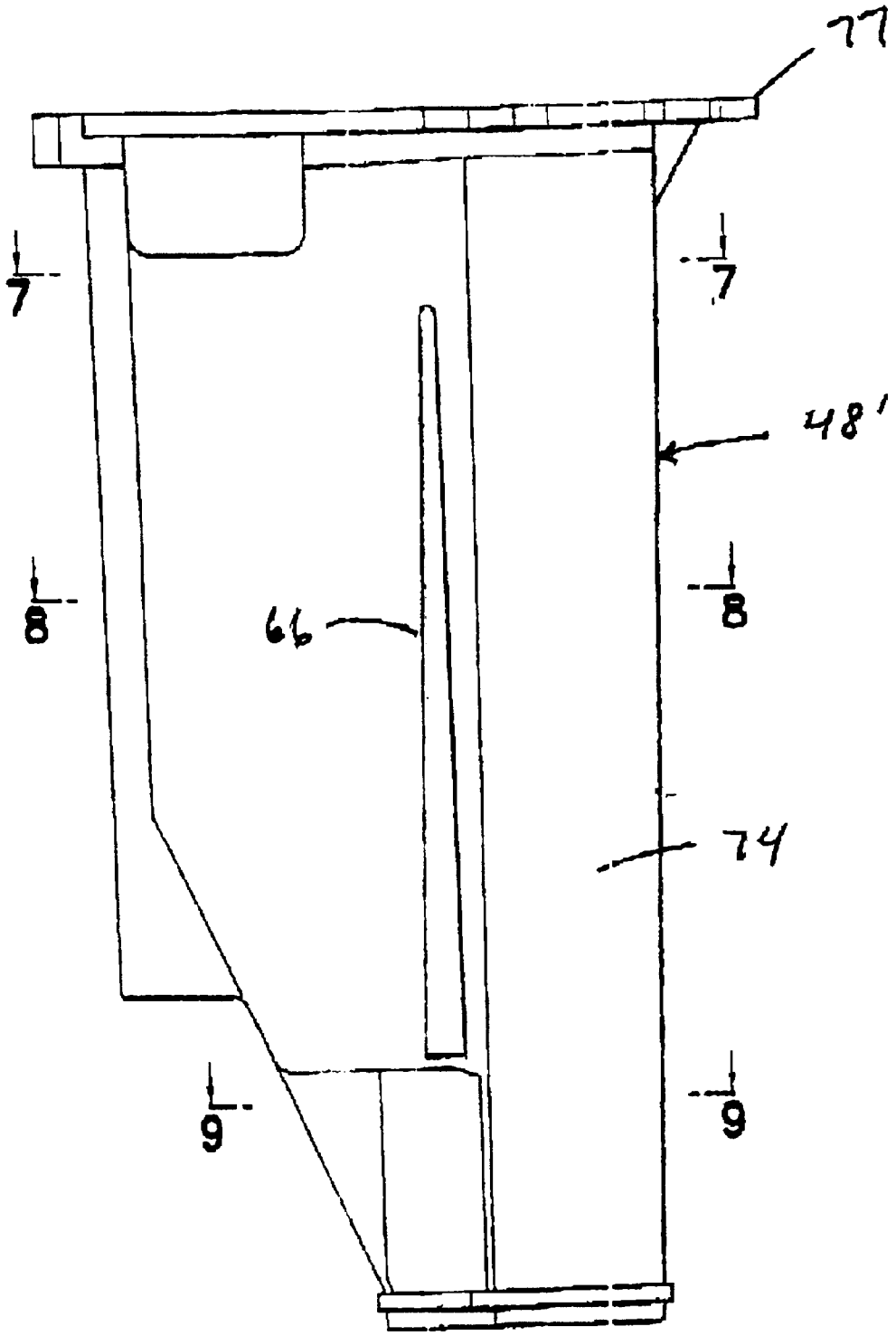
FIGS. 5 and 6 are schematics side and rear elevational views of an upper inner exhaust housing in accordance with the preferred embodiment of the invention.
Figure 6:
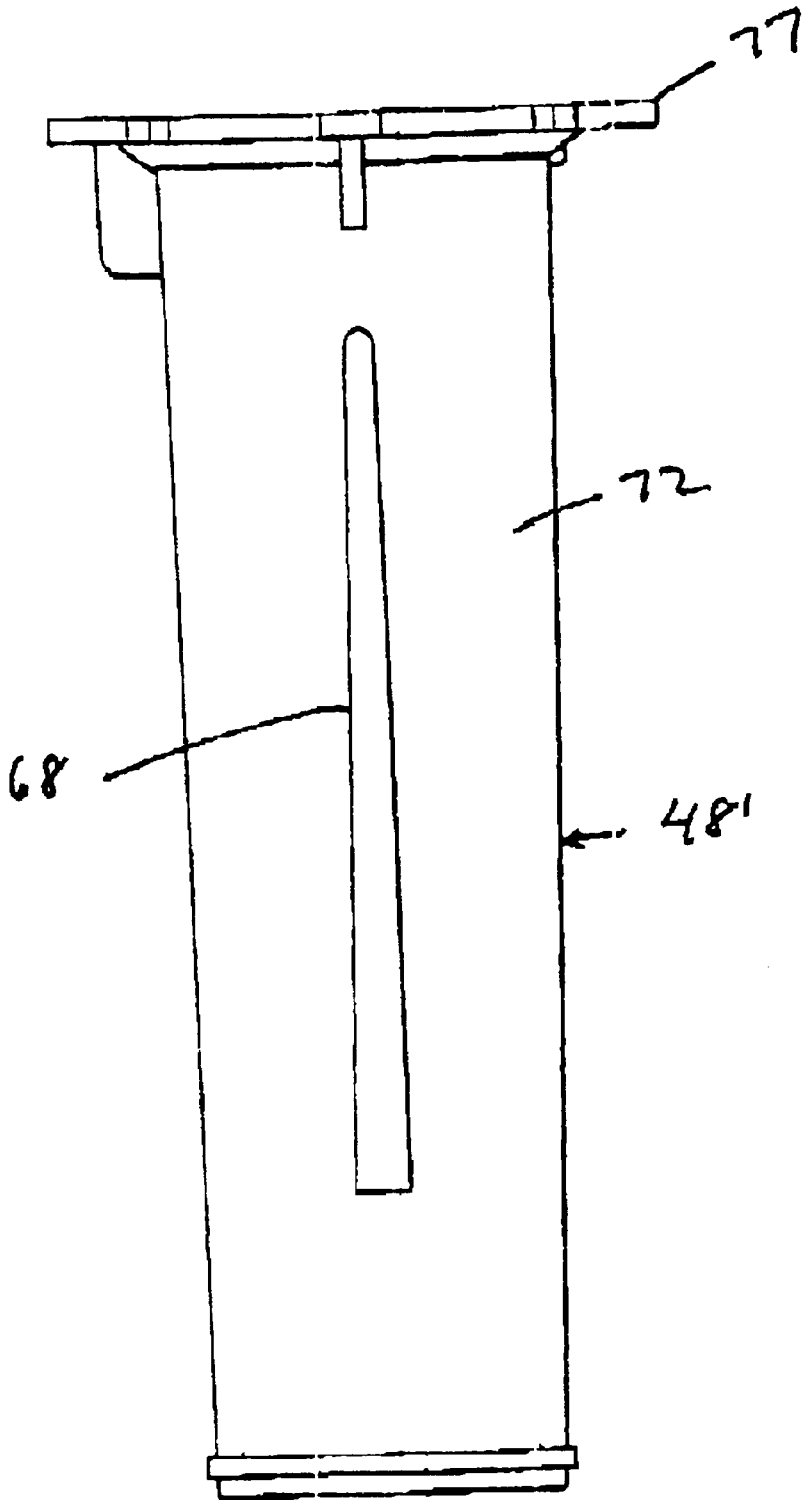

FIGS. 5 and 6 are side and rear elevational views of an upper inner exhaust housing 48' in accordance with the preferred embodiment of the invention. The only novel feature visible in FIG. 5 is the recess 66 (described in detail below), while the only novel feature visible in FIG. 6 is the channel 68 (also described in detail below). Otherwise the external appearance of the upper inner exhaust housing 48' is unchanged from that of the upper inner exhaust housing 48 shown in FIG. 4.

Figure 7:
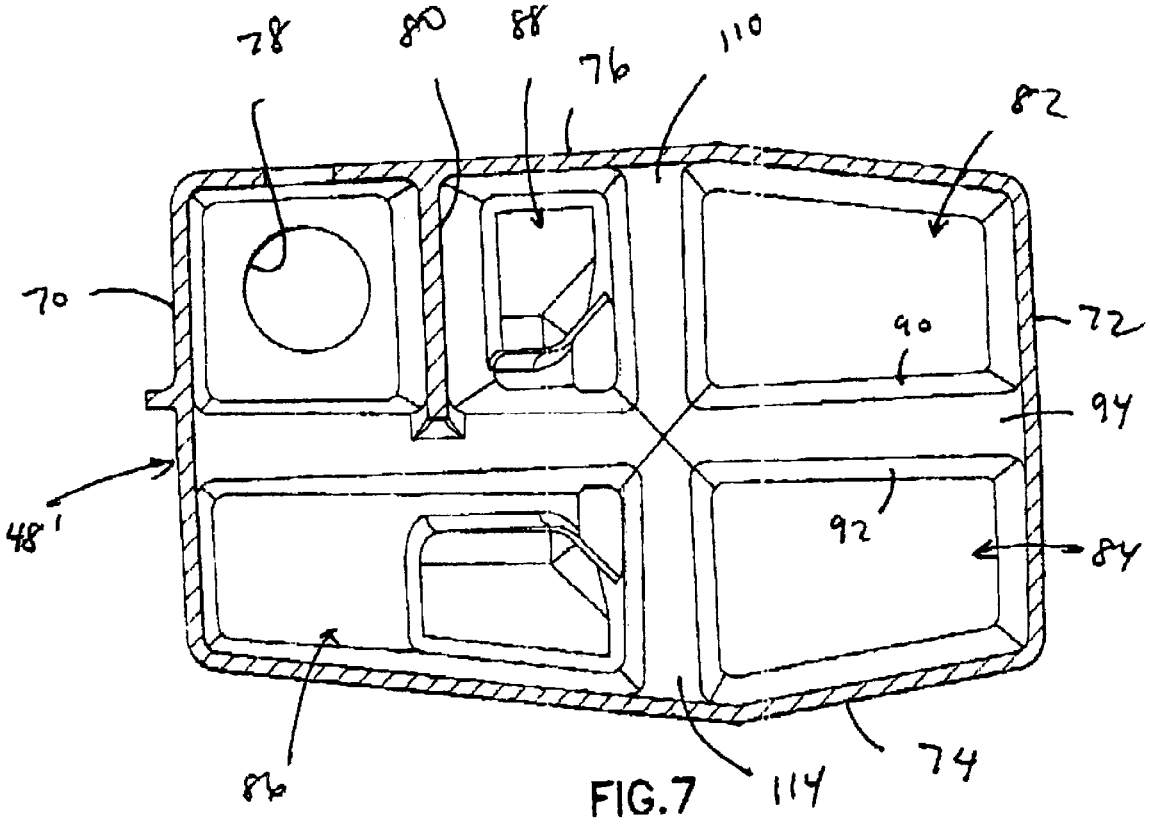
FIGS. 7–9 are schematics showing sectional views of the upper inner exhaust housing of FIGS. 5 and 6, the sections being taken along lines 7—7, 8—8 and 9—9 respectively, indicated in FIG. 5.
Figure 8:
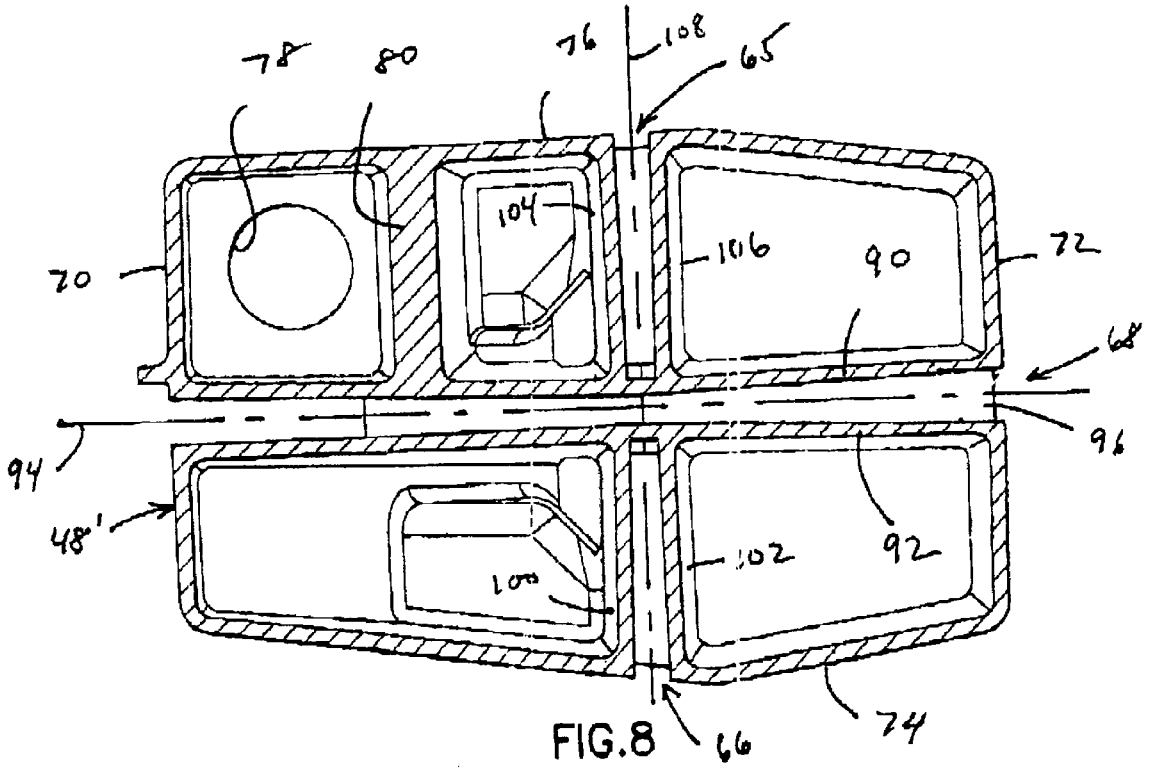
Figure 9:
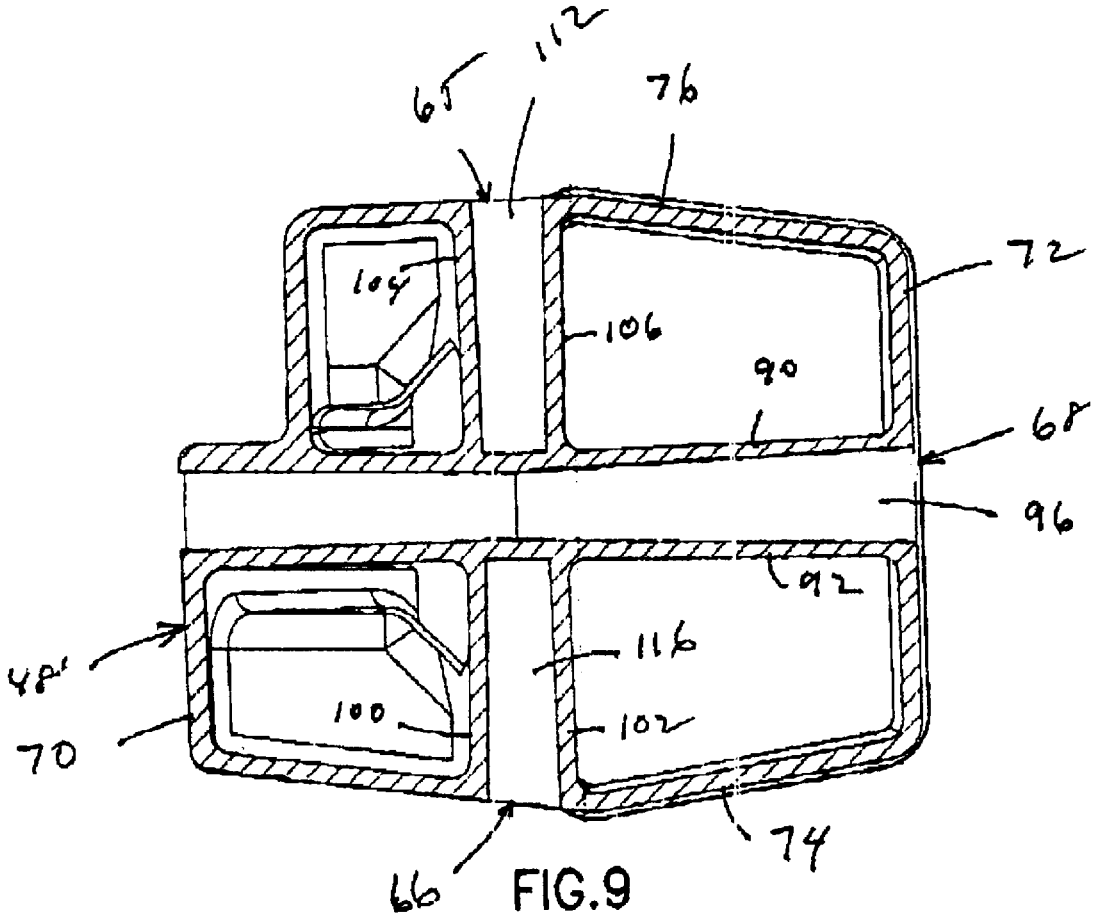
Figure 1:
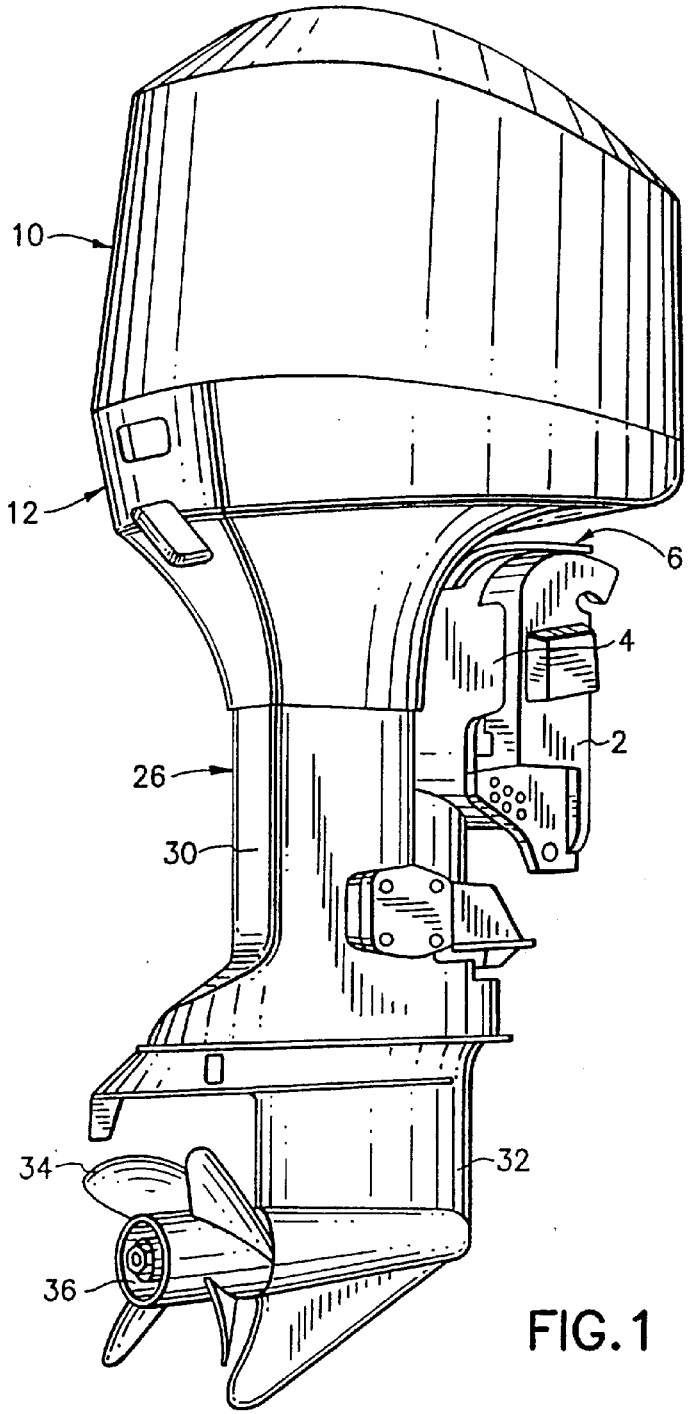
Figure 2:
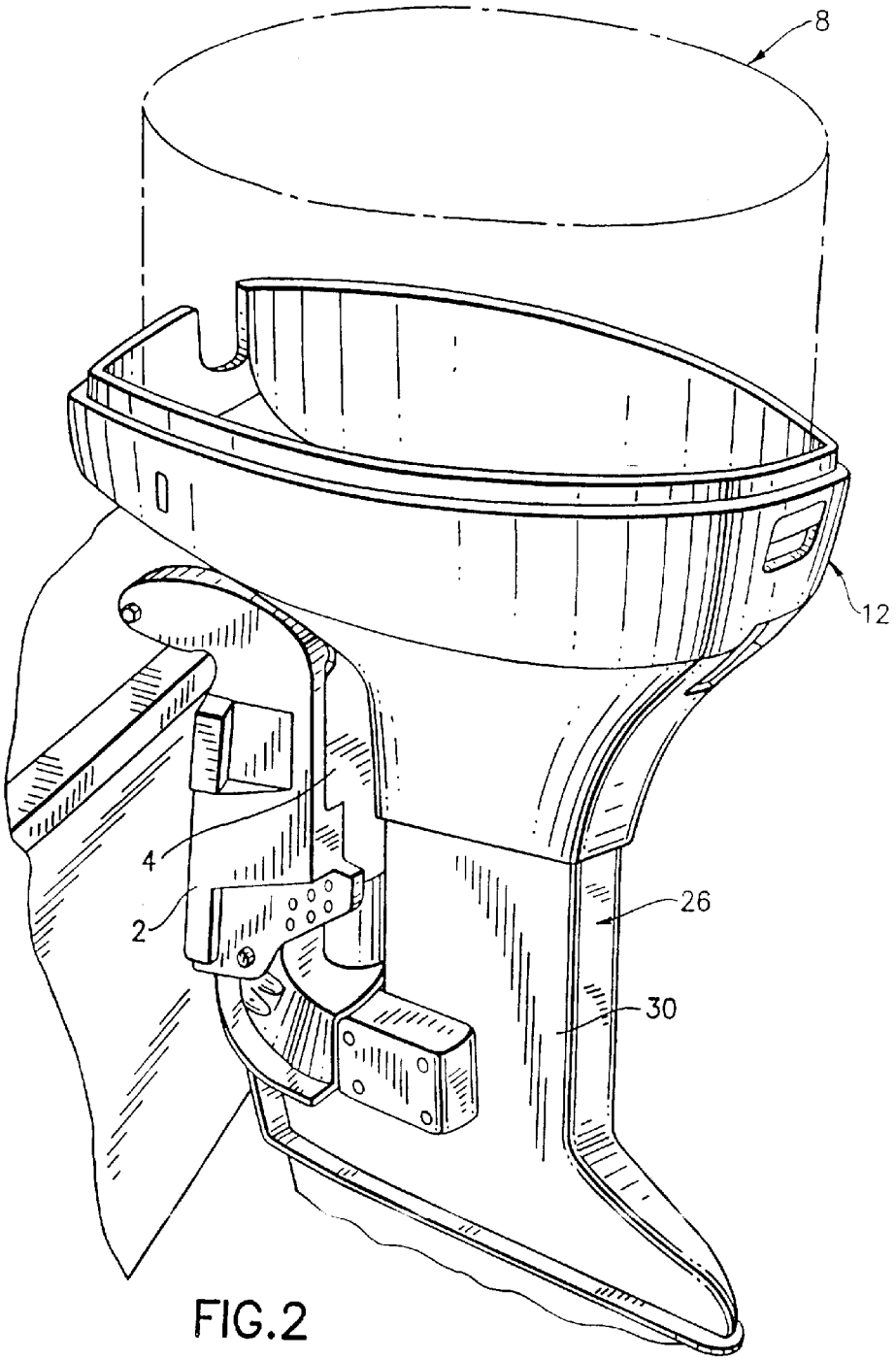
Figure 3:
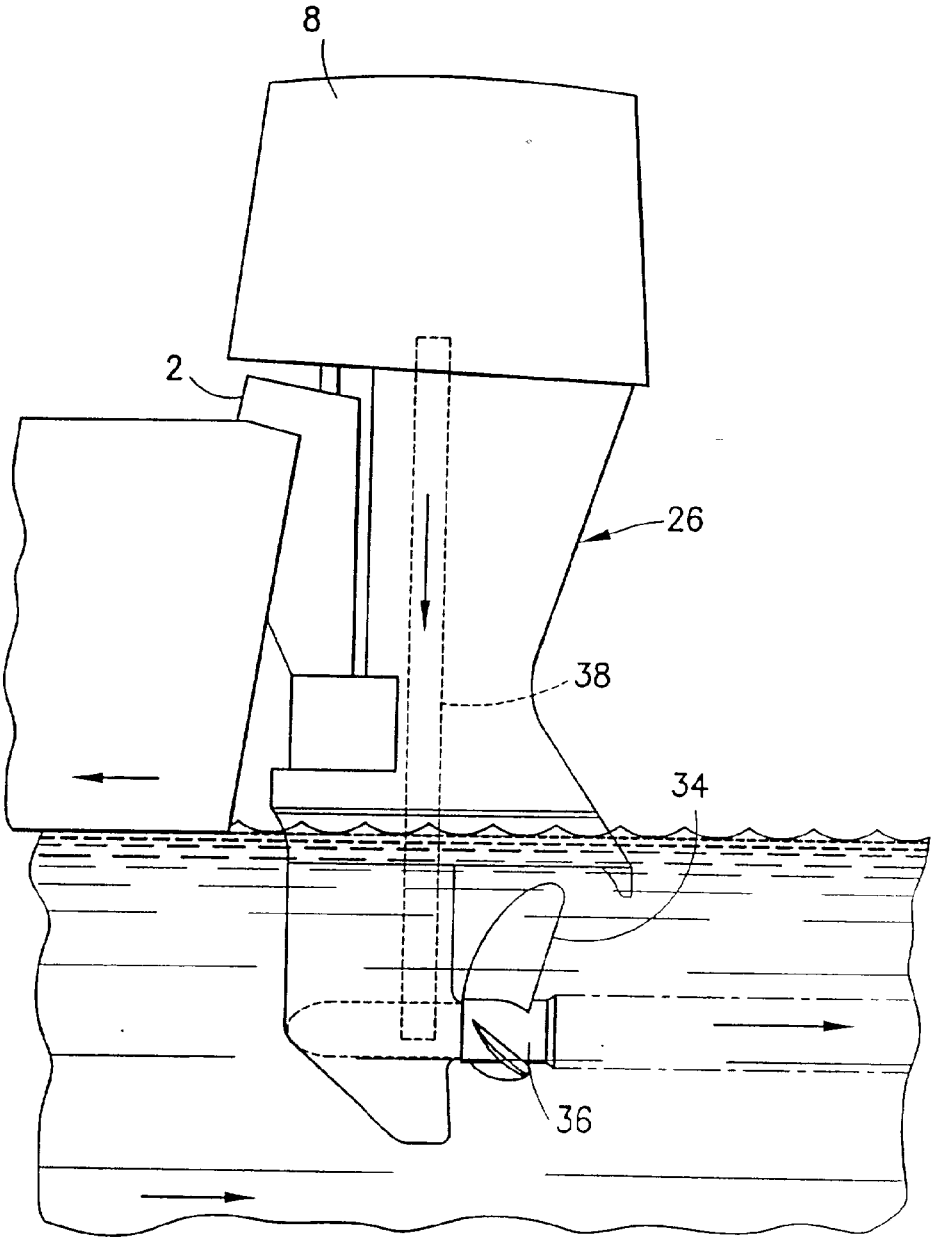
FIG.3 PRIOR ART
Figure 4:
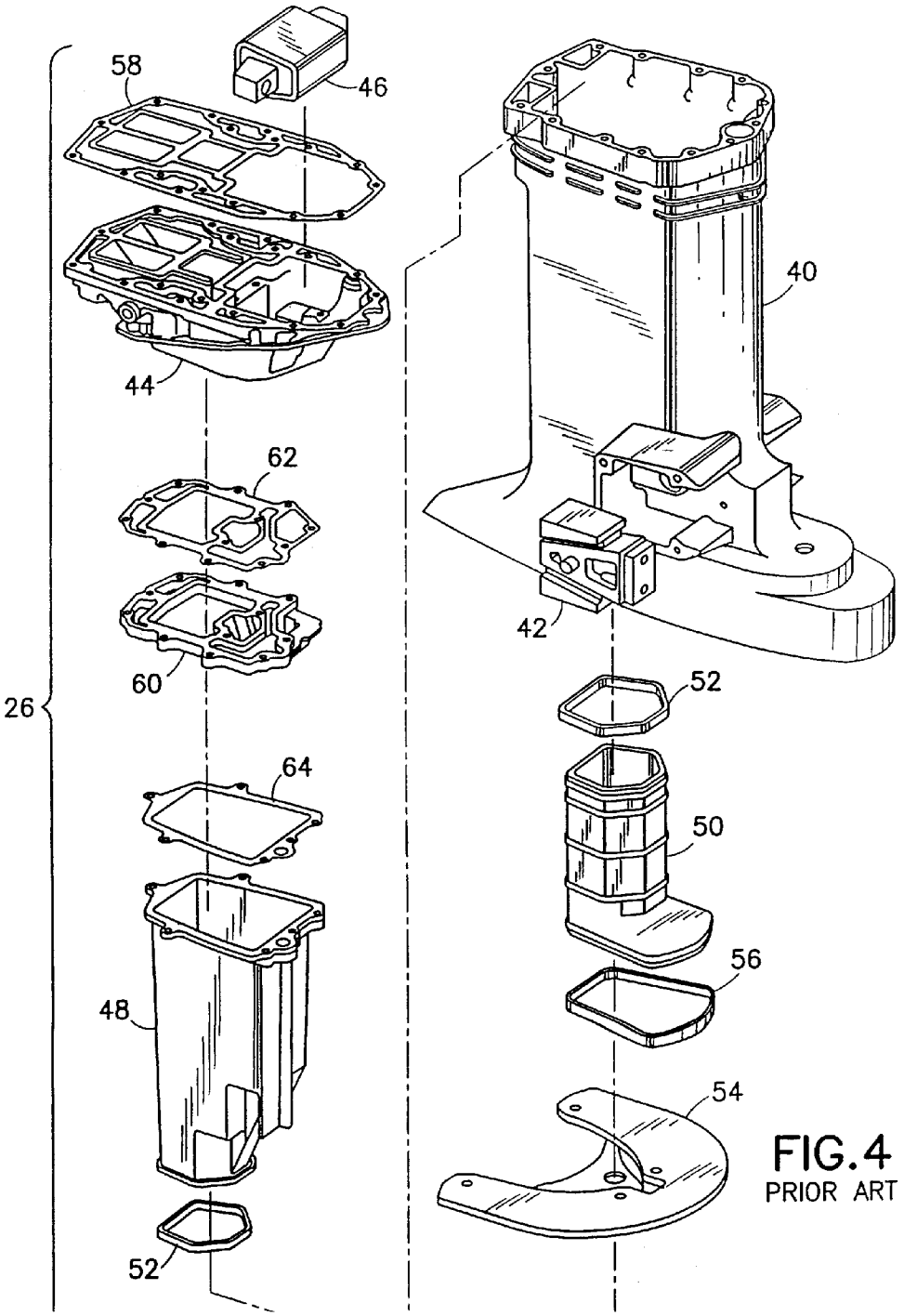
FIG.4 PRIOR ART
Figure 5:
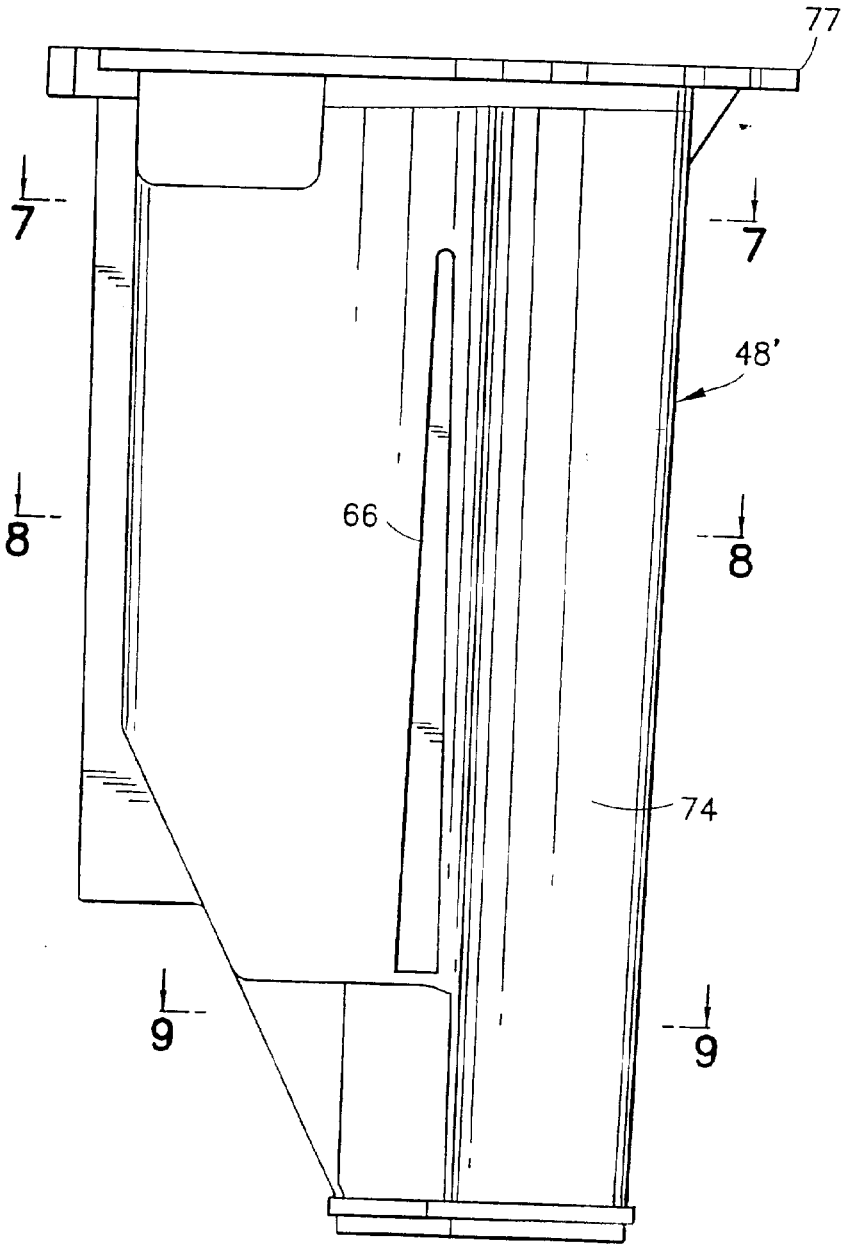
Figure 6:
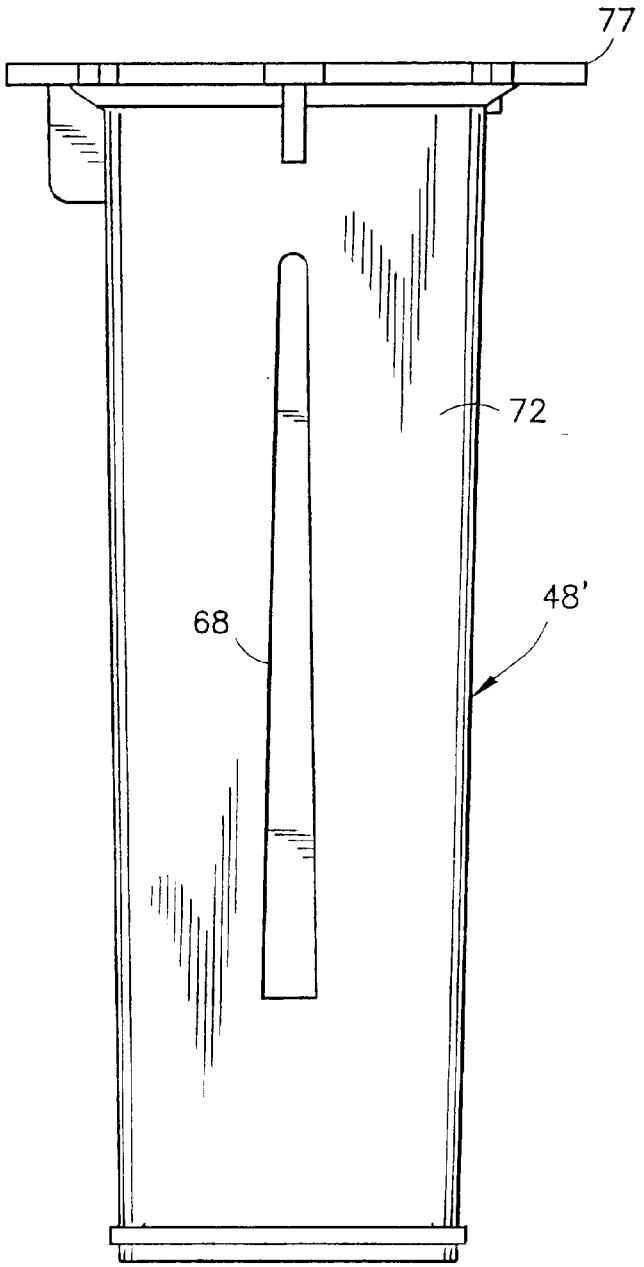
Figure 7:
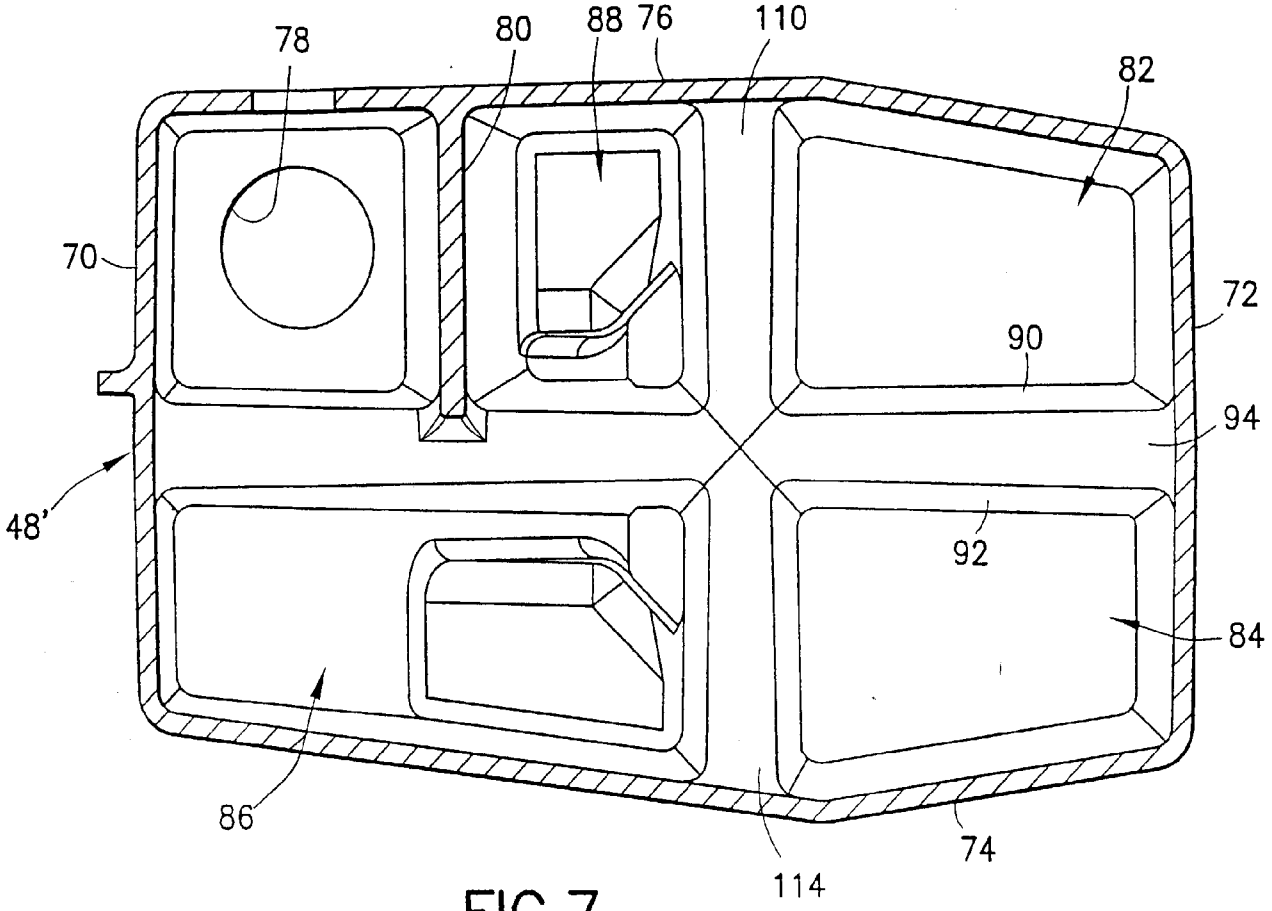
Figure 8:
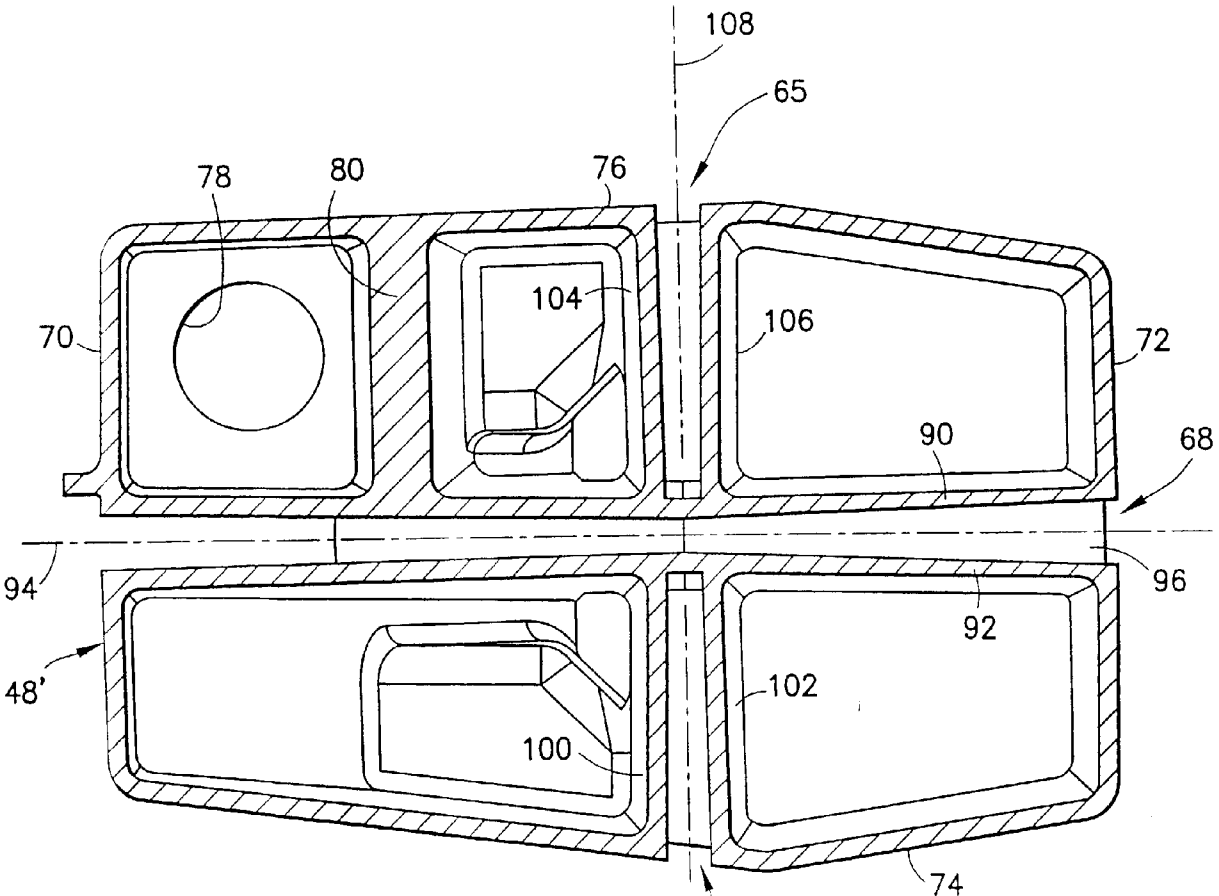
Figure 9:
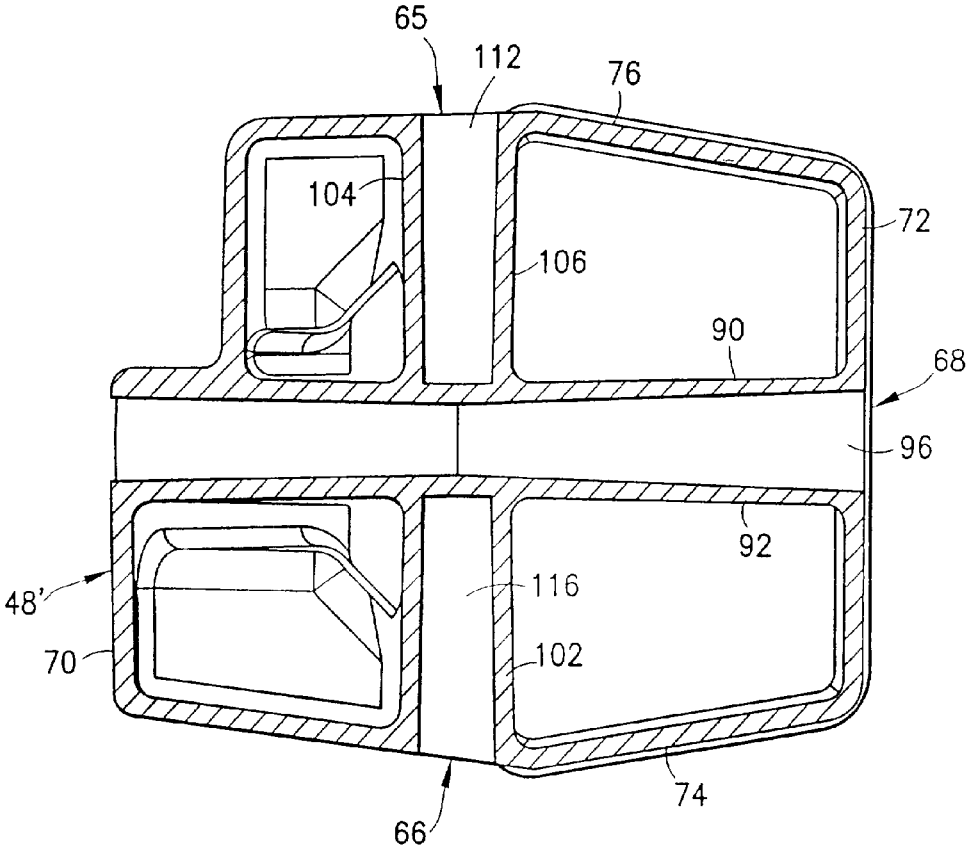

The structural features incorporated in the preferred embodiment of the invention are best seen in the sectional views of FIGS. 7–9, each section being taken along a respective horizontal plane through the upper inner exhaust housing as indicated by lines 7—7, 8—8 and 9—9 in FIG. 5.

Referring to FIG. 7, the upper inner exhaust housing 48' comprises a front wall 70, a rear wall 72, a port side wall 74 and a starboard side wall 76. These walls form a walled enclosure having an exhaust inlet at the top (in flow communication with the exhaust port of the powerhead) and an exhaust outlet at the bottom (in flow communication with the hollow propeller hub). The upper inner exhaust housing 48' is attached to the water plate (item 60 in FIG. 4) via flange 77. As best seen in FIG. 8, a circular opening 78 allows a path of least resistance at idle for exhaust gases.

In accordance with the preferred embodiment of the invention, the internal volume of the upper inner exhaust housing 48' is divided into four flow channels 82, 84, 86 and 88 by a cruciform structure, each member of the cruciform structure being attached at its distal end to a respective wall of the walled enclosure. As best seen in FIG. 8, the cruciform structure comprises a first pair of opposing, but mutually diverging, plates 90 and 92, which extend from the front wall 70 to the rear wall 72, and from an upper elevation to a lower elevation, the distance between the upper and lower elevations being less than the full height of the upper inner exhaust housing 48'. The opposing plates 90 and 92 are generally disposed with mirror symmetry on opposite sides of a mid-plane 94 of the upper inner exhaust housing 48'. The distance between the opposing plates 90 and 92 in a vertical plane perpendicular to the mid-plane increases linearly in the downward direction from the upper elevation to the lower elevation. Also, the distance between the opposing plates 90 and 92 in a horizontal plane (i.e., the plane of the paper) perpendicular to the mid-plane increases linearly in the forward direction from a central zone to the front wall 70 and also increases linearly in the rearward direction from the central zone to the rear wall 72. The upper edges of plates 90 and 92 are connected by a top strip 94 (see FIG. 7) and the lower edges of the plates 90 and 92 are connected by a bottom strip 96 (see FIG. 9) to form a cooling channel 68 (see FIG. 6) which is open at both ends, i.e., which communicates with respective openings in the front and rear walls of the upper inner exhaust housing 48'. During outboard engine operation, this cooling channel is filled with water to cool plates 90 and 92, thereby preventing damage to plates 90 and 92 due to excessive heat from the powerhead. The cooling channel 68 communicates with the water-filled space between the inner and outer exhaust housings, as previously described. The divergence (i.e., non-parallelism) of opposing plates 90 and 92 increases the stiffness of the upper inner exhaust housing 48' and also increases the volume of cooling water which can fill channel 68.

Returning to FIG. 8, the preferred embodiment of upper inner exhaust housing 48' further comprises a second pair of opposing and diverging plates 100 and 102, which extend from plate 92 to the port side wall 74, and a third pair of opposing and diverging plates 104 and 106 which extend from plate 90 to the starboard side wall 76. The second and third pairs, like the first pair, of plates are generally parallel to the direction of the powerhead exhaust gas flow down through the upper inner exhaust housing 48'. The plates 100, 102, 104 and 106 have the same height as plates 90 and 92, and extend between the same upper and lower elevations. The opposing plates 100 and 102 are generally disposed with mirror symmetry on opposite sides of a vertical plane 108 which is perpendicular to the mid-plane 94, while the opposing plates 106 and 106 are generally disposed with mirror symmetry on opposite sides of the same vertical plane 106. The distance between opposing plates 100 and 102 in a vertical plane parallel to the mid-plane 94 increases linearly in the downward direction from the upper elevation to the lower elevation. The same is true for the opposing plates 104 and 106 on the starboard side. The upper edges of plates 104 and 106 are connected by a top strip 110 and the lower edges of plates 104 and 106 are connected by a bottom strip 112 to form a recess 65 which communicates with an opening in the starboard side wall 76. Similarly, the upper edges of plates 100 and 102 are connected by a top strip 114 and the lower edges of plates 100 and 102 are connected by a bottom strip 116 to form recess 66 (see FIG. 5) which communicates with an opening in the port side wall 74. For ease of manufacture, the recesses 65 and 66 are not in flow communication with the channel 68, but optionally, the recesses could be in flow communication with the channel via openings (not shown). Preferably the distance between opposing plates 100 and 102 in a horizontal plane perpendicular to mid-plane 94 increases linearly in the port direction from plate 92 to the port side wall 74, while the distance between plates 104 and 106 in a horizontal plane perpendicular to mid-plane 94 increases linearly in the starboard direction from plate 90 to the starboard side wall 76. Again, the divergence in the opposing plates of the second and third pairs increases the stiffness of the upper inner exhaust housing 48' and also increases the volume of cooling water which may enter recesses 65 and 66 to cool the plates.

The three pairs of opposing plates 90/92, 100/102 and 104/106 divide the main inner volume of the upper inner exhaust housing into four separate channels 82, 84, 86 and 88, as shown in FIG. 7. Each flow channel has transverse dimensions which are less than the transverse dimensions of the unmodified upper inner exhaust housing, thereby increasing the frequencies of standing acoustic waves inside the upper inner exhaust housing and adding stiffness to the upper inner exhaust housing. The result is a reduction in the near-SIL123 frequency noise being transmitted from the upper inner exhaust housing during engine operation.

It is advantageous to manufacture exhaust housings in accordance with the teaching disclosed herein. Moreover, existing exhaust housings can be retrofitted to incorporate the novel structural features of the invention. At a minimum, the retrofit method comprises the steps of installing a hollow structure having an opening inside the exhaust housing, and forming an opening in exhaust housing wall at a location such that the latter opening is in flow communication with the opening of the hollow structure. In particular, the retrofitting can be performed by welding rigid plates to the walls of the exhaust housing such that the stiffness of the walled enclosure is increased.

While the invention has been described with reference to preferred embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

What is claimed is:

1. A propulsion system comprising:

a motor having an exhaust port for exhaust gases;

an exhaust housing having an inlet in flow communication with said motor exhaust port, an internal volume in flow communication with said inlet, and an outlet in flow communication with said internal volume, said inlet of said exhaust housing being at an elevation higher than an elevation of said outlet of said exhaust housing; and a structure for supporting said motor and said exhaust housing in a fixed positional relationship, wherein said exhaust housing comprises a set of plates which form first and second channels that lie side by side in said internal volume, each of said first and second channels having an inlet and an outlet, said inlets of said first and second channels being at an elevation higher than an elevation of said outlets of said first and second channels, whereby some exhaust gas flows in sequence through said inlet of said exhaust housing, said inlet of said first channel, said first channel, said outlet of said first channel, and said outlet of said exhaust housing, and other exhaust gas flows in sequence through said inlet of said exhaust housing, said inlet of second channel, said second channel, said outlet of said second channel, and said outlet of said exhaust housing.

2. The system as recited in claim 1, wherein said set of plates further form third and fourth channels that lie side by side in said internal volume, each of said third and fourth channels having an inlet and an outlet, said inlets of said third and fourth channels being at said elevation of said inlets of said first and second channels, and said outlets of said third and fourth channels being at said elevation of said outlets of said first and second channels.

3. The system as recited in claim 1, further comprising means for supporting said system outboard a boat.

4. The system as recited in claim 1, wherein said exhaust housing comprises a front wall and a rear wall, and said set of plates comprises first and second plates disposed on opposing sides of a first plane through said exhaust housing, each of said first and second plates being connected to said front and rear walls of said exhaust housing.

5. The system as recited in claim 2, wherein said exhaust housing comprises a front wall and a rear wall, and said set of plates comprises first and second plates disposed on opposing sides of a first plane through said exhaust housing, each of said first and second plates being connected to said front and rear walls of said exhaust housing.

6. A propulsion system comprising:

a motor having an exhaust port for exhaust gases;

an exhaust housing having an inlet in flow communication with said motor exhaust port, an internal volume in flow communication with said inlet, and an outlet in flow communication with said internal volume; and a structure for supporting said motor and said exhaust housing in a fixed positional relationship, wherein said exhaust housing comprises a front wall, a rear wall, a set of plates which form first through fourth channels in said internal volume, said set of plates comprising first and second plates disposed on opposing sides of a first plane through said exhaust housing, each of said first and second plates being connected to said front and rear walls of said exhaust housing, and said exhaust housing further comprises a first strip connecting a top edge of said first plate to a top edge of said second plate, and a second strip connecting a bottom edge of said first plate to a bottom edge of said second plate, each of said first and second strips being connected to said front and rear walls of said exhaust housing, said first and second plates and said first and second strips forming a cooling channel which extends along said first plane.

7. The system as recited in claim 6, wherein said front wall of said exhaust housing has an opening in flow communication with one end of said cooling channel and said rear wall of said exhaust housing has an opening in flow communication with another end of said cooling channel.

8. The system as recited in claim 6, wherein said first and second plates are separated in a second plane perpendicular to said first plane by a distance which increases continuously in said main direction to a finite value.

9. The system as recited in claim 6, wherein said first and second plates are separated in a second plane perpendicular to said main direction by a distance which increases continuously from a first finite value at a central zone to a second finite value near said rear wall of said exhaust housing and which increases continuously from a third finite value at said central zone to a fourth finite value near said front wall of said exhaust housing.

10. The system as recited in claim 6, wherein said exhaust housing further comprises first and second side walls connecting said front wall to said rear wall, and said set of plates further comprises third and fourth plates disposed on opposing sides of a second plane perpendicular to said first plane, each of said third and fourth plates being connected to said first side wall and said first plate.

11. The system as recited in claim 10, wherein said set of plates further comprises fifth and sixth plates disposed on opposing sides of said second plane, each of said fifth and sixth plates being connected to said second side wall and said second plate.

12. The system as recited in claim 10, further comprising a first strip connecting a top edge of said third plate to a top edge of said fourth plate, and a second strip connecting a bottom edge of said third plate to a bottom edge of said fourth plate, each of said first and second strips being connected to said first side wall and said first plate, said third and fourth plates and said first and second strips forming a cooling recess which extends along said second plane.

13. The system as recited in claim 12, wherein said first side wall of said exhaust housing has an opening in flow communication with said cooling recess.

14. The system as recited in claim 12, wherein said third and fourth plates are separated in a second plane parallel to said first plane by a distance which increases continuously in said main direction to a finite value.

15. The system as recited in claim 12, wherein said third and fourth plates are separated in a second plane perpendicular to said main direction by a distance which increases continuously from a first finite value at said first plate to a second finite value at said first side wall of said exhaust housing.

16. A propulsion system comprising:

a motor having an exhaust port for exhaust gases;

an exhaust housing comprising a walled enclosure having an inlet, an internal volume in flow communication with said inlet, and an outlet in flow communication with said internal volume; and a structure for supporting said motor and said exhaust housing in a fixed positional relationship, wherein said exhaust housing comprises a cruciform structure that divides a portion of said internal volume into a plurality of flow channels which extend in side-by-side relationship, each of said flow channels having an inlet located closer to said exhaust housing inlet than the flow channel outlet is and an outlet located closer to said exhaust housing outlet than the flow channel inlet is.

17. The system as recited in claim 16, wherein the number of said flow channels equals four.

18. The system as recited in claim 16, further comprising means for supporting said system outboard a boat.

19. The system as recited in claim 16, wherein said cruciform structure increases the stiffness of said walled enclosure.

20. A propulsion system comprising:

a motor having an exhaust port for exhaust gases;

an exhaust housing comprising a walled enclosure having an inlet, an internal volume in flow communication with said inlet, and an outlet in flow communication with said internal volume; and a structure for supporting said motor and said exhaust housing in a fixed positional relationship, wherein said exhaust housing comprises a hollow structure which divides said internal volume into a plurality of flow channels which extend in side-by-side relationship, each of said flow channels having an inlet located closer to said exhaust housing inlet than the flow channel outlet is and an outlet located closer to said exhaust housing outlet than the flow channel inlet is, wherein said hollow structure has an internal volume which communicates with space external to said exhaust housing via an opening in said walled enclosure.

21. The system as recited in claim 20, wherein said hollow structure comprises first and second plates disposed on opposing sides of a first plane through said exhaust housing.

22. The system as recited in claim 21, wherein said first and second plates are not parallel.

23. The system as recited in claim 21, wherein said hollow structure further comprises third and fourth plates disposed on opposing sides of a second plane perpendicular to said first plane with a space therebetween, each of said third and fourth plates being connected to said walled enclosure and said first plate, said space between said third and fourth plates communicating with space external to said exhaust housing via an opening in said walled enclosure.

24. A propulsion system comprising:

a motor having an exhaust port for exhaust gases;

an inner exhaust housing comprising a walled enclosure having an inlet, an internal volume in flow communication with said inlet, and an outlet in flow communication with said internal volume;

an outer exhaust housing surrounding said inner exhaust housing with a space therebetween; and a structure for supporting said motor and said outer exhaust housing in a fixed positional relationship, wherein said inner exhaust housing comprises a cruciform structure that divides a portion of said internal volume into a plurality of flow channels which extend in side-by-side relationship, each of said flow channels having an inlet located closer to said exhaust housing inlet than the flow channel outlet is and an outlet located closer to said exhaust housing outlet than the flow channel inlet is.

25. The system as recited in claim 24, wherein said cruciform structure increases the stiffness of said walled enclosure.

26. A propulsion system comprising:

a motor having an exhaust port for exhaust gases;

an inner exhaust housing comprising a walled enclosure having an inlet, an internal volume in flow communication with said inlet, and an outlet in flow communication with said internal volume;

an outer exhaust housing surrounding said inner exhaust housing with a space therebetween; and a structure for supporting said motor and said outer exhaust housing in a fixed positional relationship, wherein said inner exhaust housing comprises a hollow structure which divides said internal volume into a plurality of flow channels which extend in side-by-side relationship, each of said flow channels having an inlet located closer to said exhaust housing inlet than the flow channel outlet is and an outlet located closer to said exhaust housing outlet than the flow channel inlet is, wherein said hollow structure has an internal volume which communicates with said space between said inner and outer exhaust housings via an opening in said walled enclosure.

27. The system as recited in claim 26, wherein said hollow structure comprises first and second plates disposed on opposing sides of a first plane through said exhaust housing.

28. The system as recited in claim 27, wherein said hollow structure further comprises third and fourth plates disposed on opposing sides of a second plane perpendicular to said first plane with a space therebetween, each of said third and fourth plates being connected to said walled enclosure and said first plate, said space between said third and fourth plates communicating with said space between said inner and outer exhaust housings via an opening in said walled enclosure.

29. An exhaust housing for an outboard engine, comprising:

a walled enclosure having an inlet, an internal volume in flow communication with said inlet, and an outlet in flow communication with said internal volume; and a cruciform structure that divides a portion of said internal volume into a plurality of flow channels which extend in side-by-side relationship, each of said flow channels having an inlet located closer to said exhaust housing inlet than the flow channel outlet is and an outlet located closer to said exhaust housing outlet than the flow channel inlet is.

30. The exhaust housing as recited in claim 29, wherein the number of said flow channels equals four.

31. The exhaust housing as recited in claim 29, wherein said cruciform structure increases the stiffness of said walled enclosure.

32. An exhaust housing for an outboard engine, comprising:

a walled enclosure having an inlet, an internal volume in flow communication with said inlet, and an outlet in flow communication with said internal volume; and a hollow structure which divides a portion of said internal volume into a plurality of flow channels which extend in side-by-side relationship, each of said flow channels having an inlet located closer to said exhaust housing inlet than the flow channel outlet is and an outlet located closer to said exhaust housing outlet than the flow channel inlet is, wherein said hollow structure has an internal volume which communicates with space external to said exhaust housing via an opening in said walled enclosure.

33. The exhaust housing as recited in claim 32, wherein said hollow structure comprises first and second plates disposed on opposing sides of a first plane through said exhaust housing.

34. A method of retrofitting an exhaust housing comprising a walled enclosure having an inlet, an internal volume in flow communication with said inlet, and an outlet in flow communication with said internal volume, comprising the step of dividing a portion of said internal volume into a plurality of flow channels which extend in side-by-side relationship, each of said flow channels having an inlet located closer to said exhaust housing inlet than the flow channel outlet is and an outlet located closer to said exhaust housing outlet than the flow channel inlet is, wherein said dividing step comprises the steps of:

installing a hollow structure having an opening inside said internal volume of said exhaust housing; and forming an opening in said walled enclosure, wherein said opening of said walled enclosure is in flow communication with said opening of said hollow structure.

35. The method as recited in claim 34, wherein said installing step comprises the step of attaching a rigid plate to said walled enclosure at two separate locations such that the stiffness of said walled enclosure is increased.

* * * * *

UNITED STATES PATENT AND TRADEMARK OFFICE

CERTIFICATE OF CORRECTION

PATENT NO. : 6,350,166 B1
DATED : February 26, 2002
INVENTOR(S) : Eric Herrera

It is certified that error appears in the above-identified patent and that said Letters Patent is hereby corrected as shown below:

Title page,
The title page should be deleted to appear as per attached title page.

Drawings,
The sheets of drawings consisting of figures 1-9 should be deleted to appear as per attached sheets.

Signed and Sealed this

Twentieth Day of August, 2002

*Attest:*

*Attesting Officer*

JAMES E. ROGAN
*Director of the United States Patent and Trademark Office*

(12) United States Patent
Herrera

(10) Patent No.: US 6,350,166 B1
(45) Date of Patent: Feb. 26, 2002

(54) OUTBOARD ENGINE WITH RESONANCE-AVOIDING EXHAUST HOUSING

(75) Inventor: Eric Herrera, Burlington, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/571,752

(22) Filed: May 15, 2000

(51) Int. Cl.[7] ..... B63H 21/26

(52) U.S. Cl. ..... 440/89; 440/76; 440/78; 440/88; 440/60; 440/312; 440/313; 440/314

(58) Field of Search ..... 440/89, 88, 76, 440/78; 60/312, 313, 314

(56) References Cited

U.S. PATENT DOCUMENTS

| | | | | |
|---|---|---|---|---|
| 3,967,446 A | * | 7/1976 | Harralson et al. | 60/312 |
| 4,337,054 A | * | 6/1982 | Holtermann et al. | 440/89 |
| 4,795,383 A | * | 1/1989 | Binversie et al. | 440/89 |
| 4,940,435 A | * | 7/1990 | Osborn et al. | 440/89 |
| 5,149,284 A | * | 9/1992 | Kawai | 440/52 |
| 5,171,177 A | * | 12/1992 | Hubbell | 440/78 |
| 5,494,467 A | * | 2/1996 | Sohgawa et al. | 440/89 |
| 6,056,611 A | | 5/2000 | House et al. | 440/88 |

* cited by examiner

*Primary Examiner*—S. Joseph Morano
*Assistant Examiner*—Lars A. Olson
(74) *Attorney, Agent, or Firm*—Dennis M. Flaherty

(57) ABSTRACT

A propulsion system for a boat has a powerhead or a motor with an exhaust port for exhaust gases. The exhaust gases are exhausted through the propeller hub via an exhaust housing. The exhaust housing is a walled enclosure having an inlet, an internal volume in flow communication with the inlet, and an outlet in flow communication with the internal volume. The exhaust housing further includes hollow structures for dividing a portion of the internal volume into a plurality of flow channels which extend in side-by-side relationship. The transverse dimensions of each flow channel is substantially less than the transverse dimensions of the walled enclosure. The result is that standing waves are shifted to a higher frequency range. The hollow dividing structures have internal volumes which communicate with space external to the exhaust housing via openings in the walled enclosure, which allow the admission of a cooling medium. The hollow structures increase the stiffness of the walled enclosure of the exhaust housing.

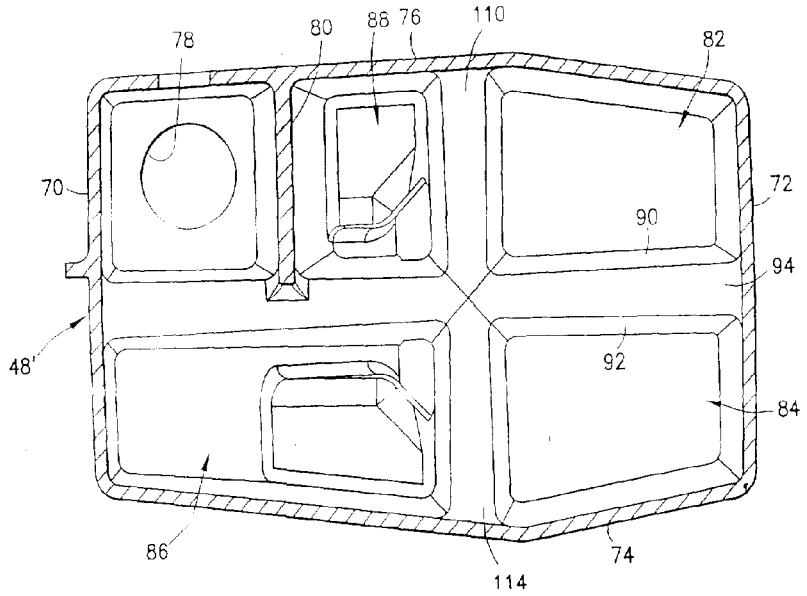

35 Claims, 9 Drawing Sheets